US007600635B2

(12) United States Patent
Kern

(10) Patent No.: US 7,600,635 B2
(45) Date of Patent: Oct. 13, 2009

(54) HIGHLY COMPRESSED FILTER TOW BALES AND PROCESS FOR THEIR PRODUCTION

(76) Inventor: Dietmar Kern, Vogesenstrasse 17, 79350 Sexau (DE)

( * ) Notice: Subject to any disclaimer, the term of this patent is extended or adjusted under 35 U.S.C. 154(b) by 252 days.

(21) Appl. No.: 10/858,990

(22) Filed: Jun. 2, 2004

(65) Prior Publication Data

US 2005/0161358 A1 Jul. 28, 2005

Related U.S. Application Data

(60) Provisional application No. 60/475,544, filed on Jun. 3, 2003.

(30) Foreign Application Priority Data

Apr. 22, 2002 (DE) ..... DE 102 17 840.2

(51) Int. Cl.
*B65D 71/00* (2006.01)

(52) U.S. Cl. ..... 206/83.5; 206/388; 206/442; 206/524.8

(58) Field of Classification Search ..... 206/524.8, 206/388, 442, 83.5; 53/438, 432, 434, 176, 53/449; 493/39–50
See application file for complete search history.

(56) References Cited

U.S. PATENT DOCUMENTS

| | | | | |
|---|---|---|---|---|
| 3,458,966 | A * | 8/1969 | Hullhorst et al. | 53/430 |
| 3,968,877 | A | 7/1976 | Mattis | |
| 3,988,499 | A * | 10/1976 | Reynolds | 428/216 |
| 4,157,754 | A | 6/1979 | Bartsch et al. | |
| 4,577,752 | A | 3/1986 | Meredith, Jr. | |
| 4,942,719 | A | 7/1990 | Fleissner | |
| 5,775,058 | A | 7/1998 | Hirschek | |
| 2002/0117215 | A1 | 8/2002 | Skeens | |

FOREIGN PATENT DOCUMENTS

| | | |
|---|---|---|
| DE | 1951113 B | 4/1971 |
| DE | 76 35 849 | 3/1977 |
| DE | 3405182 A1 | 10/1984 |
| EP | 0908 642 | 4/1999 |
| FR | 1480095 A | 3/1967 |
| GB | 1133147 A | 11/1968 |
| GB | 1 280 932 | 7/1972 |

(Continued)

OTHER PUBLICATIONS

Notice of Opposition to EP Patent No. EP 1 497 186 B1.

(Continued)

*Primary Examiner*—J. Gregory Pickett
(74) *Attorney, Agent, or Firm*—Fay Sharpe LLP; Karl W. Hauber

(57) ABSTRACT

Disclosed is a packed, highly compressed cuboid-shaped filter tow bale, the top side and bottom side of which are free from noisome curvatures or constructions. A method for producing the bale comprises the following: (a) filter tow is supplied in a compressed form: (b) the compressed filter tow is enveloped in a wrapping; (c) the wrapping is closed in an airtight manner; and (d) the wrapped bale is relieved of the load. The wrapping of such a bale is largely prevented from bursting as a result of the prevailing internal pressure.

21 Claims, 4 Drawing Sheets

FOREIGN PATENT DOCUMENTS

| | | |
|---|---|---|
| GB | 1 310 029 | 3/1973 |
| GB | 1 438 481 | 6/1976 |
| JP | 06-238839 | 8/1994 |

OTHER PUBLICATIONS

Acetate Tow for Cigarette Filters cigatow, Daicel Chemical Industries, Ltd. Jan. 12, 2007.

Plastics—Determination of Tensile Properties Part 3: Test Conditions for films and sheets, International Standard, Aug. 1, 1995.

Translation of International Preliminary Examination Report.

International Search Report.

Some Useful Information about the Reusable Packaging for Rhodia Filter Tow, Rhodia Acetow.

* cited by examiner

HIGHLY COMPRESSED FILTER TOW BALES AND PROCESS FOR THEIR PRODUCTION

This application claims priority of prior filed Provisional Application Ser. No. 60/475,544 filed Jun. 3, 2003. This application also claims priority of PCT/EP03/04132 filed Apr. 22, 2003, which in turn claims priority of German Application Serial No. DE 102 17 840.2 filed Apr. 22, 2002.

FIELD OF THE INVENTION

The invention pertains to a packaged, highly compressed bale of filter tow material in block or cuboid form without any interfering bulges or constrictions in the top or bottom of the bale and to a process for its production.

BACKGROUND OF THE INVENTION

In the production of filter tow for use in making filter rods for the cigarette industry, the tow is laid in so-called "filling cans". During this process, the filter tow is distributed in uniform layers over the cross-sectional area of the can by the movements of a laying unit, which moves alternately in the lengthwise and crosswise direction. As a result, a large number of layers are laid on top of each other until the filter tow package has reached the desired weight and height in the can. Package weights of several hundred kilograms are conventional in this area. A highly compressed bale and a process for the optimal filling of a can for the purpose of avoiding consequent processing problems is described in WO 02/32,238 A2.

The content of the can which has been filled in this way is then compressed in the direction in which the layers were superimposed. After it has been compressed, the filter tow package is wrapped with packaging material while still inside the pressing device and therefore still under compressive stress. The pressing device is then opened completely, so that the filter tow package, now called the "bale", is held together by the packaging material. Conventional packaging materials include cardboard, which is held mechanically together by strapping or by an adhesive, and synthetic fabric, which is closed by, for example, a Velcro fastening. An example of a glued package is described in German Utility Patent No. 76-35,849.1. Information on a filter tow package wrapped with synthetic fabric can be found in the company prospectus "Some Useful Information about the Reusable Packaging for Rhodia Filter Tow", published by RHODIA Acetow GmbH, Engesserstrasse 8, D-79108 Freiburg. The two latter types of packaging require no additional strapping.

The types of packaging described above which do not make use of any strapping suffer from the problem that, after the pressure on the bale has been released at the end of the pressing operation, the elastic restoring force of the compressed filter tow leads to a pressure on the packaging, this pressure being exerted primarily in the direction opposite that in which the bale was compressed. This leads to an increase in the volume of the package and thus to undesirable bulges at the top and bottom of the bale. If the measures described in WO 02/32,238 A2 are taken, these bulges do not interfere with the intended use of the filter tow, but they do prevent the filter tow packages from being stacked securely. This problem is solved in the state of the art either by stacking the bales on their sides or by the use of special pallets, such as those described in the Rhodia publication cited above. Problems associated with the bursting-open of the packages because of excessive internal pressure also occur frequently.

A solution to the difficulties associated with strapping is described in U.S. Pat. No. 4,577,752. In cases where filter tow which has been packaged with straps is used as intended, the bulges are less of a problem than the constrictions, which cause the variations in puff resistance described in WO 02/32, 238 A2. And even strapped bales can burst open. It is also standard practice in the packaging of filter tow to use liners between the filter tow and the above-mentioned mechanically supportive packaging materials. The liner protects the filter tow from contamination, especially from odor contamination, and from the diffusion of water vapor into and out of the package. The liner usually consists of three pieces, which are laid loosely inside the external packaging.

The disadvantages of the transport packaging normally used today have already been discussed above in the description of the state of the art. It is especially the bulges at the top and bottom of the bales which interfere with transport of multiple layers. This problem has been solved in the past by transporting the bales not in their so-called working position but rather in a sideways storage position. Two additional work steps are required to do this, however; namely, the bale must be turned 90° before transport and then turned back into the working position after transport. The constrictions which are formed by strapping are also a source of trouble. Even when the bale is used as intended, these constrictions cause considerable variations in the puff resistance of the filter rods produced from the filter tow. More than 5% of the filter rods produced from a bale are affected by these variations. The greater the packing density of the bale, the greater the severity of these two problems. The problems occur as soon as the packing density exceeds 300 kg/m$^3$.

SUMMARY OF THE INVENTION

According to one embodiment, the invention provides a highly compressed bale of filter tow in cuboid or block form without the bulges which interfere with the transport of the bales and without the constrictions in the top and bottom of the bale which interfere with the pay-out of the filter tow. The compressive load to which the packaged filter tow is subjected is reduced, so that in particular the bursting-open of the package under the effect of internal pressure can be almost completely avoided. According to another embodiment, the invention provides a corresponding packaging process.

In accordance with one aspect of the present invention, a packaged, highly compressed bale of filter tow is provided. In one embodiment, the bale of filter tow includes a plurality of layers of filter tow material defining an upper and lower side having a packing density. The packing density is at least 300 kg/m$^3$. The bale further includes a resilient packaging material fully enclosing the bale. The packaging material includes at least one convective air-tight connection. The upper side and lower sides of the bale are substantially planar.

In accordance with yet a further aspect of the invention, a packaged, highly compressed bale of filter tow is provided. The bale of filter tow includes a plurality of layers of filter tow material defining an upper and lower side having a packing density. The packing density is at least 300 kg/m$^3$. An elastic packaging material is provided which fully encloses the bale. The packaging material includes at least one joint which is air-tight with respect to convection. The upper and lower sides of the bale are substantially planar, such that when an unopened bale is placed on a horizontal surface, a flat plate can be pressed onto the upper side of the bale with a force of 100N acting in the normal direction on a center of the bale wherein a rectangle can be inscribed in a vertical projection of the bale onto the pressed on plate, and at least 90 percent of the area of the upper side which is located within the inscribed rectangle is less than 40 mm from the plate.

In accordance with another aspect of the invention, a method for packaging a filter tow bale is provided. The method includes the steps of providing a plurality of filter tow material in a filling can, and compressing the layers of filter tow into a bale using a pressing device having a load. The method further includes wrapping the bale with a packaging wrapper, sealing the packaging wrapper, and releasing the load from the bale.

BRIEF DESCRIPTION OF THE DRAWINGS

The invention is explained in greater detail below on the basis of a preferred embodiment with reference to the attached drawing.

DETAILED DESCRIPTION OF THE PREFERRED EMBODIMENTS

Figure 1A:
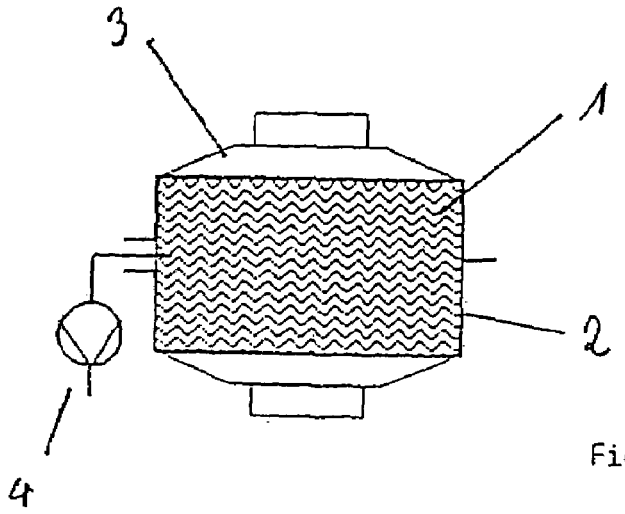
FIGS. 1*a*-1*c* show the individual steps of an embodiment of the process according to the invention.

After a series of failed experiments, the surprising discovery was made that it is possible to prepare a block-shaped bale without the bulges which interfere with transport and without the constrictions which interfere with the intended use of the filter tow by sealing the packaging air-tight during the packaging process. On the basis of practical considerations, therefore, a bale according to one embodiment is completely wrapped with a mechanically self-supporting, elastic packaging material. The packaging material can have one or more joints which are air-tight with respect to convection.

Upon a preliminary, superficial analysis, it might appear that the bale according to the invention is a vacuum-packed bale and thus a vacuum package such as that familiar to all consumers on the basis of daily experience. This is not the case, however. The goal to be achieved with the block-shaped bale according to the invention is to create a defined shape. The air-tight packaging has the task of absorbing and equalizing the pressure gradients which occur at the top and bottom of the bale during the production process. It turned out that it was no longer necessary to impose requirements on the packaging with respect to its mechanical strength, its permeability to air and moisture, etc. It was found instead that the bale according to the invention would retain its properties even if the previously air-tight material were to be perforated over large areas after the packaging process. On the basis of practical considerations, such an additional measure will not be taken.

The geometry of the bale according to the invention can be described as having a top and bottom side that are substantially planar, such that when the unopened bale is placed on a horizontal surface, a flat plate completely covering the bale can be pressed onto the top of the bale with a force of 100N acting in the normal direction on the center of the bale with the result that, within the largest rectangle which can be inscribed in a vertical projection of the bale onto the pressed on plate, at least 90% of the area of the top surface of the bale which is located within the inscribed rectangle is less than 40 mm away from the flat plate. The distance of the individual points on the top surface of the bale from the plate can be determined, for example, by using a transparent plate and by determining the distances between the individual points and the plate by measuring the reflections. As an alternative, any other continuous method of distance measurement can also be used. Within the scope of the principle according to the invention, it is especially preferred for 90% of the area of the top surface of the bale which lies within the previously mentioned inscribed rectangle to be less than approximately 25 mm, preferably less than approximately 10 mm, away from the flat plate.

In regard to the packing volume of the bale, it is has been found advantageous for the bale to have a volume of more than 0.9 $m^3$ and/or for the packing density to be between 350 $kg/m^3$ and 800 $kg/m^3$. In connection with the loading of the packages into containers, it is has been found to be especially suitable for the bale to have the form of a cuboid or block with a height of at least approximately 900 mm, preferably of at least approximately 970 mm. In this case the bales can be stacked in double layers in the container. Packaged blocks with heights of 970-1,200 mm are especially favorable, since such blocks can be placed in the form of individual stacks in the containers. It is also possible to produce much taller bales, which reduces the packaging work relative to the amount of fibers to be packaged. In cases where the packaged material is filter tow, these large packages offer the advantage that, when the filter is used to produce cigarette filters in a filter rod machine, the frequency of replacing the bales is reduced.

The packaging wrapper is preferably made of a plastic film. The convectively air-tight joint can be made as a convectively air-impermeable seam, which is advantageously designed as a heat-sealed overlapping or finned seam.

The film consists preferably of polyethylene, especially LDPE, or modified polyethylene (LLDPE), or of a laminated film including a layer of polyamide and a layer of polyethylene. For advertising and aesthetic purposes, colored or printed film can be used as the packaging film. This is especially advisable when the filter tow to be packaged is sensitive to light and/or is subjected to light. The film can also be provided with adhesive labels, which provide information on the content of the package, for example. Another possibility of allowing the package to convey information is to impress a relief into it, which is visible through the film, which conforms tightly to the surface of the package as a result of negative pressure. In addition to the name of the product, the relief can also contain a company and/or customer logo. The film preferably has properties which make it a reliable transport packaging material. Films with thicknesses in the range of 100-400 μm can be used. If desired, a transport packaging of cardboard, synthetic fabric, etc., can be placed around the film after the package wrapping or film itself has been sealed, that is, after the block-shaped bale has been completed. This transport packaging can then be strapped as well. As a result, the mechanical stability of the packaging is increased, so that thinner and therefore less expensive film can be used. It must be emphasized, however, that transport packaging of this type is not mandatory within the scope of the invention.

A process for packaging a filter tow bale according to the invention comprises the following process steps:

(a) the filter tow is prepared in compressed form with a pressing device having a load;

(b) the compressed filter tow is wrapped with packaging film;
(c) the package wrapper is sealed air-tight; and,
(d) the load on the wrapped bale is released.

When the load on the bale, which has been sealed air-tight, is released, a negative pressure develops inside the package wrapper, which is preferably at least 0.01 bar below ambient pressure and which according to an especially advantageous method is in the range of 0.15-0.7 bar below ambient pressure.

Because of the air-tight seal of the package wrapper, the negative pressure thus produced inside the region surrounded by the wrapper can be maintained. This negative pressure reduces the pressure which the elastic restoring force of the flexible material exerts on the packaging from the inside. For this reason, the bulges which normally develop on the filter tow bales according to the state of the art are avoided. It thus becomes much easier to stack the packaged bales thus produced. Because the mechanical pressure acting from the inside on the packaging is reduced (by the negative pressure), the risk of failure or the tendency of the packaging to rip open is also reduced. A higher packing density can thus also be achieved, which leads to the advantage of more compact packages and thus to the ability to reduce the storage and transport volumes. In particular it is possible in this way to make optimal use of the holding capacity of containers, in which such packaged filter tow is stored.

The provision of filter tow in compressed form is usually accomplished with the help of known pressing devices. The process according to the invention can be conducted in such a way that the quantity of filter tow intended for the package is first mechanically compressed in the pressing device and then wrapped with the package wrapper. In this case the package wrapper is sealed while it is still inside the pressing device. This embodiment offers the advantage that the entire process is completed at a single location.

It is also possible to compress the filter tow at a separate station as a preparatory step. In this case, the precompressed filter tow is provided with "auxiliary packaging", which can consist of retaining clamps, for example, and then sent to the packaging station, where the auxiliary packaging is removed, the compressed filter tow is wrapped with the package wrapper, the negative pressure is produced, and the package wrapper is sealed air-tight. This embodiment offers the advantage that the pressing device can have greater availability, because the entire process is not completed at one location. In addition, the duration of the pressing cycle is decreased, and there are more degrees of freedom available with respect to the application of the package wrapper, because the compressed bale is accessible from all sides in the packaging station.

In contrast to the state of the art, the use of the process according to the invention makes it possible to eliminate the liner intended to protect the bale from contamination and water vapor, because these tasks are already accomplished by the wrapper used as packaging.

The negative pressure required initially in the process according to the invention can be obtained in various ways. According to an especially simple embodiment, the negative pressure is generated by the "natural" expansion of the compressed filter tow material. After the filter tow has been wrapped in the compressed state with the package wrapper and this has been sealed air-tight, the external pressure on the packaged material is released. As a result, the material expands inside the package under the action of its own elastic restoring force. Because of the increase in the volume of the package, a negative pressure develops inside the region surrounded by the wrapper. The package size is preferably selected so that the compressed filter tow cannot expand completely, that is, so that the filter tow inside the wrapper is still compressed to a certain degree inside the package even after its partial expansion. This embodiment has the advantage that no additional means are required to generate the negative pressure. It therefore represents an especially low-cost possibility.

According to another embodiment, which can be used as an alternative or as an addition to the previously described variant, the negative pressure is produced by exhausting air from the interior area surrounded by the wrapper. In this way, a vacuum higher than the "natural" vacuum described above can be obtained. It is also possible by this method to adjust the desired negative pressure with a high degree of accuracy.

The air can be exhausted by means of, for example, one or more vacuum pumps. These are first connected on the suction side to the interior of the otherwise air-tight package and then put into operation. After the desired negative pressure has been reached, the pumps are disconnected from the package, and the exhaust connection points in the packaging wrapper are sealed air-tight again.

A combination of the two previously described embodiments offers the advantage that the evacuation times can be kept short, because the negative pressure is obtained by two different measures, which can be performed simultaneously. In addition, the necessary compression forces are smaller, because a larger packing height can be selected, where the term "packing height" refers to the height of the filter tow bale after it has been sealed air-tight in the device used to compress the filter tow. Finally, it is possible in this way to regulate the height of the filter tow bale with good accuracy. As a result, external influences such as those associated in particular with the seasons, with titer, and with weight, etc., can be moderated.

In the process according to the invention, a negative pressure of approximately 0.15 bar to 0.7 bar below ambient pressure is preferably produced. This corresponds to an absolute pressure of approximately 0.30-0.85 bar inside the film-wrapped volume. The vacuum in question is therefore in the "low vacuum" range, which is usually completely sufficient for the process according to the invention. A negative pressure of approximately 0.2-0.4 bar, corresponding to an absolute pressure of approximately 0.6-0.8 bar, has proven to be especially suitable. The choice of the concrete range for the negative pressure depends on various parameters, especially on the type and quantity of the material to be packaged, on the desired packing density, on the package wrapper used, etc. In principle, it must be remembered that the stronger the vacuum or negative pressure, the more compact the packages which can be obtained. Increasing the negative pressure also has the effect of reducing the bulges. It must also be taken into consideration, however, that choosing a higher vacuum leads to a disproportionate increase in the time required to achieve that desired negative pressure.

As far as the packaging wrapper used in the process according to the invention is concerned, it should be selected so that the desired stability of the produced negative pressure over time and the desired mechanical stability of the packaging are guaranteed. Depending on the type of package material or film and on the manner in which it is used, the desired stability over time will usually vary between a few days and several months or even years. Accordingly, films with different air permeabilities can be used.

According to one embodiment, preferably a film of polyethylene or modified polyethylene such as LLDPE or LDPE can be used as the package wrapper. LDPE is low-density polyethylene, which is produced under high pressure; LLDEP is the designation for low-density polyethylene with a linear structure. A plastic film of this type offers the advantage that it is a pure material and can be obtained at low cost. A sheet of polyethylene, however, is not very strong and is therefore suitable especially for relatively low packing densities and small quantities of packaged material. Because of the relatively high permeability to air of standard polyethylene film, it is more suitable for uses in which the storage time does not exceed a few weeks.

As an alternative, it is possible advantageously to use a laminated film made of polyamide and polyethylene as the package wrapper. This laminate is characterized by a very low degree of permeability to air and by high strength, which means that the negative pressure can be kept constant over a long period. The polyamide layer preferably represents approximately ⅓ of the laminate, the polyethylene layer approximately ⅔.

The gas permeability of the package wrapper or film to air is preferably less than 10,000 $cm^3/(m^2*d*bar)$, preferably less than 200 $cm^3/(m^2*d*bar)$, and even more preferably less than 20 $cm^3/(m^2*d*bar)$. These values are measured according to DIN 53,380-V at 23° C. and 75% relative humidity. As a result, it can be guaranteed that the vacuum will last for a sufficient length of time and that the package will not become loose and will remain as compact as possible. This range, furthermore, is covered by standard commercial films (e.g., PA-PE laminates). It must be emphasized that no air is transported by convection through the film; mass transport occurs only via diffusion across the film. The values indicated for permeability are based on a composition analogous to ambient air (approximately 78% $N_2$, 21% $O_2$, 1% other gases). The only important values are those pertaining to the permeability for oxygen and nitrogen. In addition to films, it is also possible within the scope of the present invention to use other air-tight materials which fulfill the above conditions.

The permeability of the film or other wrapping material to water vapor should preferably be less than 5 $g/(m^2*d)$, preferably less than 2 $g/(m^2*d)$, measured according to DIN 53,122, Part 2, at 23° C. and 85% relative humidity. The permeability to water vapor is not relevant to the shape-giving function of the packaging, but a packaging which is impermeable not only to air but also to water vapor offers the advantage that the product moisture content of the filter tow remains preserved by such a packaging. This is very important in the case of filter tow. Thus the moisture content will equalize over the bale, and there will be no exchange of moisture with the environment. Polyethylene films with a thickness of 100 μm have an approximate water vapor permeability of 1 $g/(m^2*d)$.

In regard to the mechanical strength, the package wrapper or film should advisably have a tear strength of at least approximately 10 N/15 mm, preferably of more than 100 N/15 mm, and even more preferably of more than 200 N/15 mm, measured according to DIN EN ISO 527-3. Each of the cited values pertains to the minimum tear strength value in the longitudinal and transverse directions of the film. The selection with respect to tear strength can be made as a function of whether or not the film-wrapped bale will be repackaged for transport. In this context, possible materials include PE with a tear strength of 15-30 N/15 mm at a thickness of 100 μm and PA6 with a tear strength of 150-300 N/15 mm at a thickness of 100 μm.

In general, plastic films with air-barrier layers such as layers of polyamide, polyester, or ethylene-vinyl alcohol copolymer (EVOH) or with a metal oxide coating such as a coating of $SiO_x$, aluminum oxide, etc., and aluminum foils have been found to be especially advantageous. This list of films is not to be considered exhaustive, however. Because of the impermeability of the film to air, aroma protection, that is, protection against the intrusion of aromas from the outside, is also afforded, which can be advantageous for various types of packaged materials. A certain toughness is important for the mechanical stability of the film. This property is offered especially by polyamide.

One possibility of obtaining an air-tight seal of the package wrapper or film is to weld or to heat-seal it. Accordingly, the selected film should preferably be weldable or heat-sealable. In this regard, favorable film materials are those with low melting points. For example, polyolefins such as polyethylene and polypropylene or copolymers with ethylene and propylene such as EVA, LLDPE, etc., can be mentioned here. Materials which satisfy the prerequisite of weldability or heat-sealability are called the "sealing layer" in the description that follows. A film can consist possibly of a sealing layer of this type alone or of a laminate consisting of one or more sealing layers and additional layers, which are designed to provide, for example, the mechanical strength.

To ensure that the packaging can be opened easily, the sealing layers can be "peelable"; that is, they can be sealed in an inhomogeneous manner. An inhomogeneous sealing layer of this type can be produced in various ways, such as by adding polybutylene at certain points to the sealing layer or by sealing polypropylene against LLDPE. Another possibility of facilitating the opening process consists in providing a tear-open strip in the packaging film. This possibility is especially intended for films of low toughness. Finally, projecting corners or the like can be provided, which are intended to be cut off when package is to be opened. After the projecting corner has been cut off, air can pass into the interior of the package, and the package becomes loose. Then it can be opened easily with a film-cutting knife without causing damage to the package contents.

As an alternative, the packaging wrapper or film can be sealed by an adhesive. This embodiment offers the advantage that there is no need for a heat-sealing device. Of course, other suitable methods for sealing the packaging film can also be used as long as they provide the desired properties with respect to leak-tightness and also with respect to mechanical tensile strength required for the area of application in question.

The heat-sealing or welding can be accomplished, for example, in such a way as to form an overlapping seam. An overlapping seam can absorb comparatively high tensile forces and thus hold the packaged material together reliably even in the freshly packaged state and even if the package should have a leak and thus the full elastic restoring force of the material acts on the packaging from the inside. This type of closure is thus very secure, and the film in this case should advisably have a heat-sealing layer on both sides (or consist exclusively of such a heat-sealing layer).

According to another embodiment, the welding or heat-sealing can be accomplished in such a way as to form a finned seam, which is known to the expert in the area of film processing. This offers the advantage of being easy to produce from the outside, but the ability of such a seam to withstand tensile stresses is less than that of the overlapping seam.

The packaging wrapper or film can be designed in the form of, for example, a one-piece bag. The prepared filter tow in this case is wrapped in a manner similar to that in which a piece of candy is wrapped. As an alternative, the film can consists of a bottom, a top, and a circumferential collar. In this case, the overall length of the joint seams is increased, because the individual parts must be joined together. According to another preferred embodiment, the film packaging consists of a top and a bottom, which can possibly be fabricated, that is, deep-drawn or made into a bag, etc., before use. Finally, there is also the possibility of cutting the film into two interlocking pieces in tennis ball fashion. It would also be possible to imagine other suitable ways of designing a film packaging within the scope of the invention.

If desired, the final sealing of the package wrapper or film, that is, the completion of the film packaging, can be followed by repackaging the bale with cardboard, synthetic fabric, etc., which is placed around the film. This has the result of increasing the mechanical strength of the packaging, so that thinner and thus less expensive films can be selected. It must be emphasized, however, that repackaging of this type is not mandatory within the scope of the invention.

When external repackaging is used as described above, it is possible for the film packaging to be designed intentionally with less air-tightness, so that the negative pressure is equalized within one to two days with respect to the ambient pressure. In other words, the package "loses" its vacuum within this period. The packaged filter tow thus expands into the external packaging, but in comparison with filter tow packaged according to a process of the state of the art, it has less pronounced bulging at the top and bottom of the package.

The film used in the process according to the invention preferably has a thickness of approximately 100-400 μm, where a range of 200-300 μm and especially of 250-300 μm has proven to be especially suitable. The exact thickness of the film used will be selected as a function of the size and the weight of the fiber material to be packaged, of the degree of compression, that is, of the packing density, and of the type of film material used. As already explained above, a somewhat thinner film can possibly be selected when additional external packaging, especially an outer packaging of cardboard, is used.

The compressible filter tow to be packaged is thus in particular made available in the optimal block form. As a result, packages can be obtained which are especially easy to stack and to handle and easy to store. The filter tow, which is in the form of cables, is preferably laid in layers, one on top of the other, as already described in connection with the process according to the state of the art.

Referring now to FIGS. 1-5, a bale of a compressible, flexible, fibrous material 1, which is filter tow in the present case, is there illustrated. The fibrous material 1 can be wrapped with a film 2 and introduced into a pressing device 3 (FIG. 1*a*). In the pressing device 3, which is able to exert a pressure or load of, for example, 300-400 tons, the bale is compressed to the desired packing height. Then the film 2 is sealed air-tight except for a small area, which can serve as a connection point for the suction hose of a vacuum pump 4, such as a sliding vane rotary pump or the like. The interior of the region wrapped by the film 2 can be evacuated by the vacuum pump 4 to a desired negative pressure. Once this has been reached, the hose of the vacuum pump is disconnected from the film, and the connecting point is sealed air-tight. As previously mentioned, the use of a vacuum pump can be omitted if only a small degree of negative pressure is desired, such as that which can be obtained by the expansion of the bale.

Figure 1B:
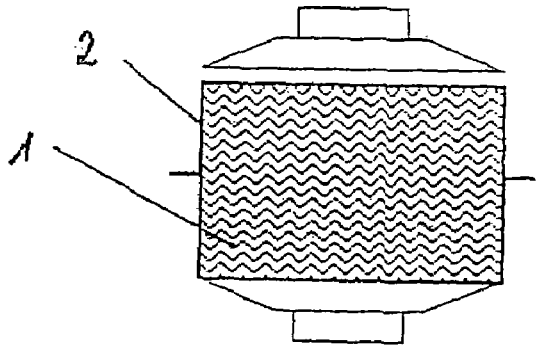
Figure 1C:
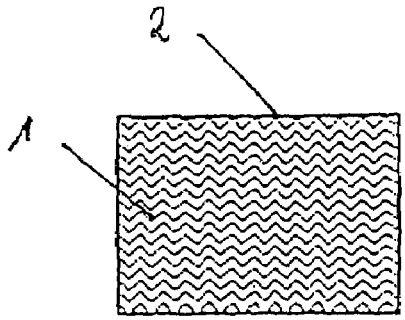

In the next step, shown in FIG. 1*b*, the pressing device 3 is opened. The bale thus expands again to the extent allowed by the size of the film packaging. The filter tow bale in its finished packaging can now be removed from the pressing device and is in a state in which it can be transported and stored, as indicated in FIG. 1*c*. The height of the packaged bale depends on various factors, including the strength of the vacuum which was produced.

Figure 2A:
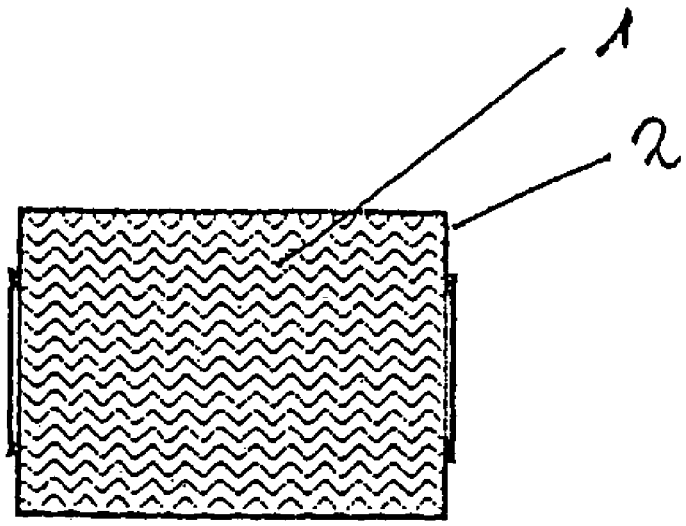
FIGS. 2*a* and 2*b* show an elaborated form of the package obtained according to the process of the invention.
Figure 2B:
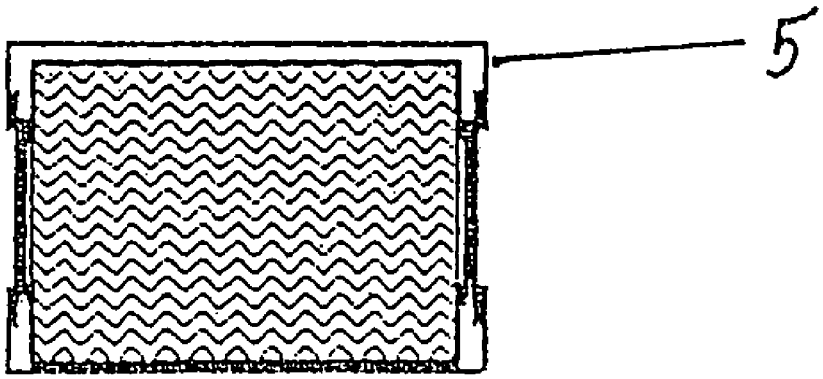

FIGS. 2*a* and 2*b* show another stage of the process according to the invention, namely, the optional provision of the packaged filter tow bale with external packaging 5. This can be provided in particular for the purpose of transport and can consist, for example, of light-weight cardboard. These types of outside packaging materials are known to the expert and thus do not need to be explained in detail here.

Figure 3A:
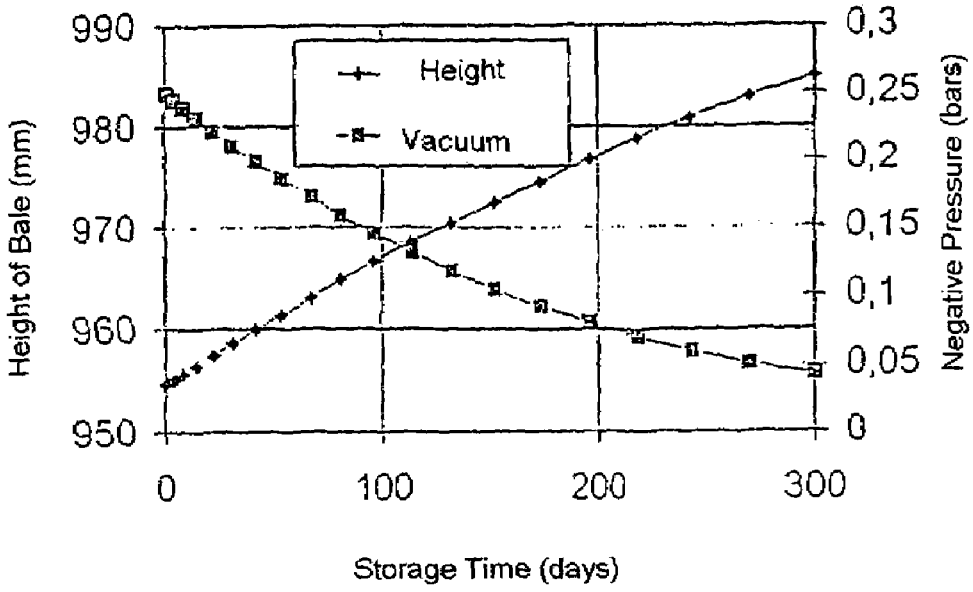
FIG. 3*a* shows a graph, which represents the change over time in the properties of a package obtained according to the process of the invention with the use of polyethylene film.
Figure 3B:
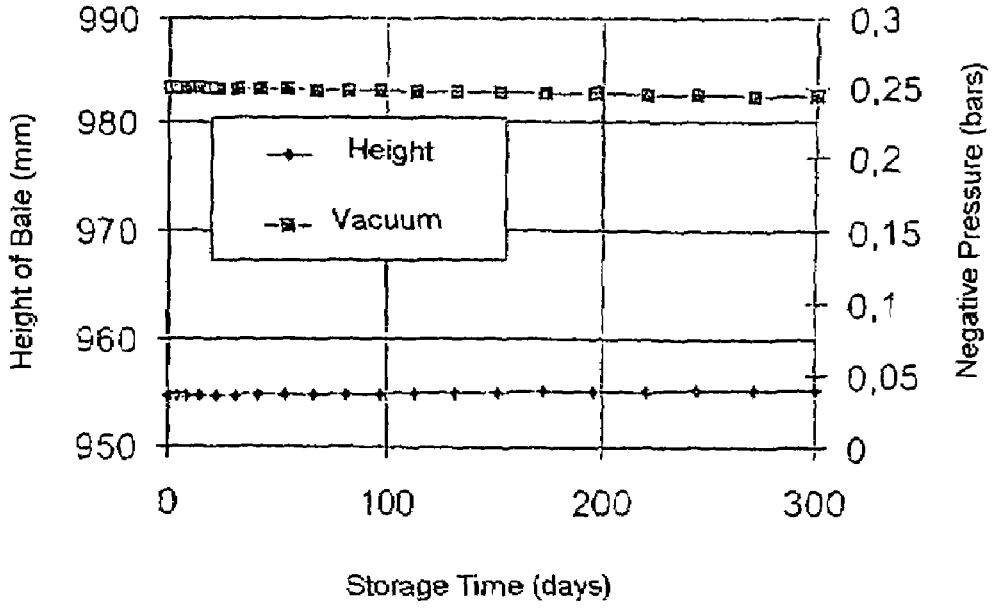
FIG. 3*b* shows a graph similar to that of FIG. 3*a*, which applies to a laminated film of polyethylene and polyamide.

FIGS. 3*a* and 3*b* show graphs which represent the change over time in the properties of packages produced by the process according to the invention based on the use of a film of polyethylene and of a laminated film of polyethylene and polyamide The polyethylene film of FIG. 3*a* has a gas permeability of approximately 600 ml/($m^2$*d*bar), whereas the gas permeability of the laminated film of FIG. 3*b* is only about 10 ml/($m^2$*d*bar). As can be derived from a comparison of the two graphs, the negative pressure produced in the case of the laminated film remains essentially constant over the course of several hundred days, as does the height of the bale. In contrast, the negative pressure in the case of the bale wrapped in polyethylene film has already decreased by half after only a little more than 100 days, whereas the height of the bale has increased by more than 10 cm in the same time period. If the bales are to be stored for up to two years or more, the laminated film is therefore to be preferred despite its higher cost.

Figure 4A:
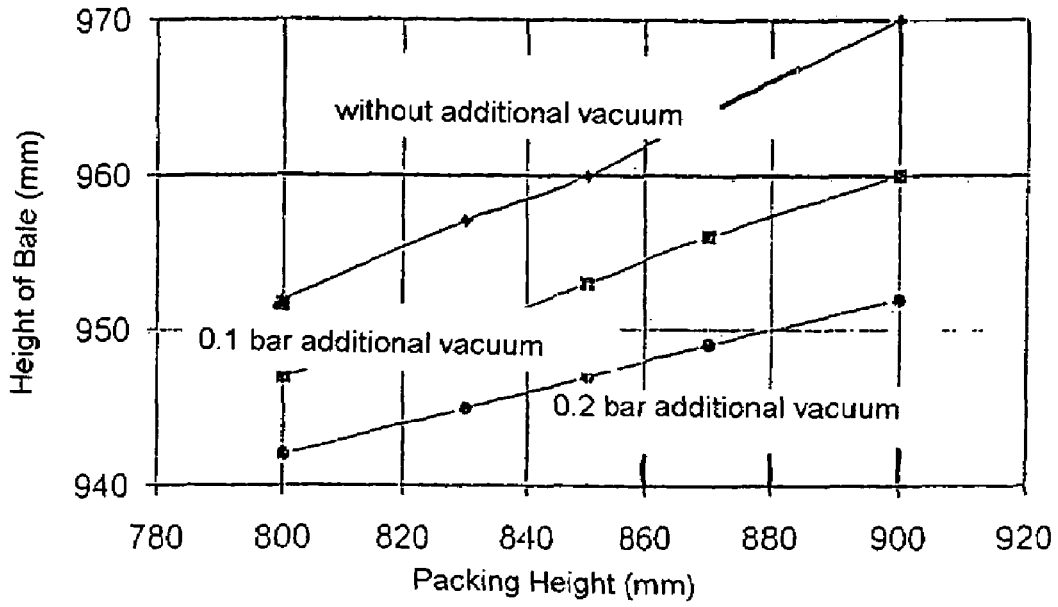
FIG. 4*a* shows various curves which illustrate the relationship between the packing height and the height of the bale for various negative pressures; and, FIG. 4*b* shows various curves which illustrate the relationship between additional vacuum and the height of the bale at elevated temperature and reduced air pressure.

As can be seen in FIG. 4*a*, the height of the bale can be decreased by increasing the strength of the vacuum. Three different curves are shown in the figure. The one at the top shows the achievable height of the bale as a function of the packing height without the use of a vacuum pump. The curve in the middle shows the results obtained when an additional vacuum of 0.1 bar is applied, and the curve at the bottom shows the results obtained when an additional vacuum of 0.2 bar is applied. Filter tow of type 3Y35 with a bale weight of 580 kg was processed at a pressure of 370 tons. Under these conditions, an additional vacuum of 0.1 bar can be produced reliably in about 60 seconds.

Figure 4B:
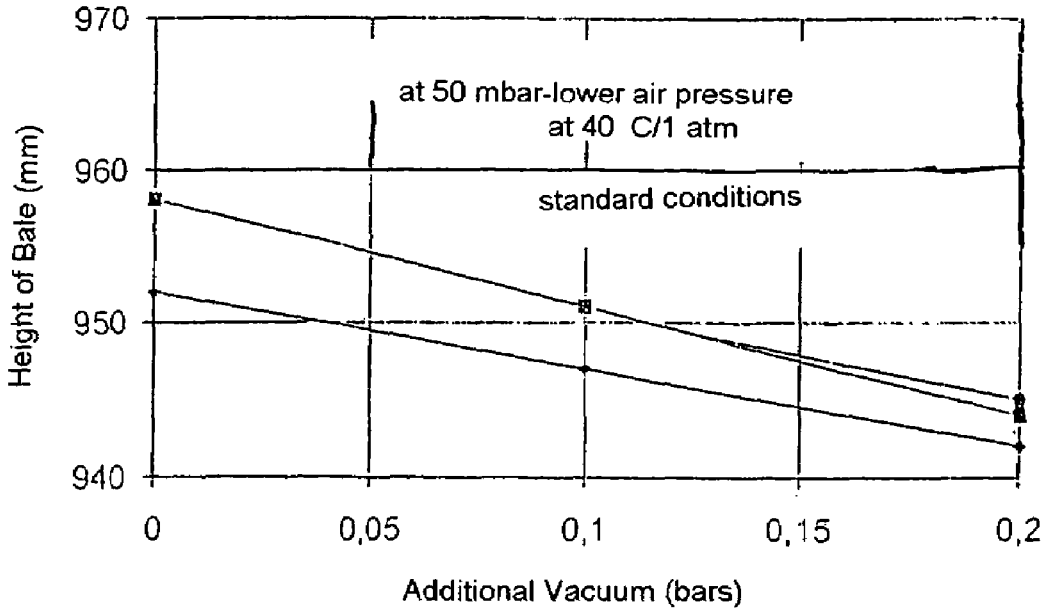

FIG. 4*b* shows the height of the bale under modified ambient conditions as a function of the strength of the additional vacuum, where the air temperature was approximately 40° C. and the pressure of the ambient air was approximately 0.05 bar higher than in the example of FIG. 4*a*. It can be seen that the height of the bale increases at lower air pressures and higher temperatures.

A laminated film of polyethylene and polyamide with a thickness of approximately 200 μm was used in the exemplary embodiment described above. The film was heat-sealed by hand with a sealing device, where a collar part was joined to a top and a bottom element, each of which was pretrimmed in the press. The pressing force was 370 tons in all cases. The packaging costs could be considerably reduced by means of the process according to the invention.

According to another experiment, a bale of the same weight with a packing height of 900 mm was wrapped in a laminated film of polyamide and polyethylene, which was then welded shut. After the pressing device was opened, the height of the bale was 970 mm. There were no bulges anywhere in the packaged bale. By virtue of the increase in the volume of the air inside the bale, a negative pressure of 0.12 bar, corresponding to an absolute pressure of 0.88 bar, was reached. This negative pressure was achieved without the help of a vacuum pump.

In another experiment, a bale of the same weight with a packing height of 900 mm was wrapped in a laminated film of polyamide and polyethylene, which was then welded shut. The interior of the package was evacuated by means of a vacuum pump to a negative pressure of 550 bars, corresponding to an absolute pressure of 450 bars. After the pressing device was opened, the height of the bale increased to approximately 930 mm. The pressure in the interior of the package was calculated at 0.42 bar, corresponding to a negative pressure of 0.58 bar. Again, there were no bulges in the packaged bale.

The invention has been described with reference to several embodiments. Obviously, modifications and alterations will occur to others upon a reading and understanding of this specification. It is intended to include all such modifications and alterations insofar as they come within the scope of the appended claims and the equivalents thereof.

The invention claimed is:

1. A packaged, highly mechanically compressed bale of filter tow comprising:

a plurality of layers of filter tow material are layed in successive layers from a lower side to an upper side defining an upper and lower side of an upright said bale of filter tow having a packing density, wherein said bale of filter tow is in block form, and wherein said upper and lower sides are without interfering bulges;

said packing density is at least 300 kg/m$^3$ from said mechanical compression;

a resilient elastic packaging material fully enclosing said bale in a mechanically self-supporting manner, wherein said packaging material includes convective joints that are air-tight connections with respect to air convection;

said upper side and said lower side are substantially planar wherein the planarity of said upper and lower sides is defined, such that when said lower side of said bale is placed on a horizontal surface, a flat plate can be pressed onto said upper side of said bale by a force of 100N acting in the normal direction on a center of said bale wherein, within the largest rectangle which can be inscribed in a vertical projection of said bale onto the pressed-on plate, at least 90% of the area of said upper side of said bale which is located within the inscribed rectangle is less than 40 mm from the plate;

said bale includes a height of at least 900 mm;

wherein in said packaged bale a negative pressure from about 0.01 bar to about 0.4 bar relative to an outside pressure is present at least immediately after said bale has been packaged, wherein said packaging material maintains said negative pressure and equalizes pressure gradients at said upper and lower sides, and wherein said negative pressure reduces the pressure which the elastic restoring force of said filter tow material exerts on the packaging from the inside such that a stacking orientation includes a lower side of one said bale is securely stackable directly upon an upper side of another said bale;

said stacking orientation of both said bales is the same as the upright orientation of said plurality of layers of filter tow material; and, wherein said air-tight connections include heat sealed seams.

2. The bale of filter tow of claim 1, wherein said bale includes a packing volume of at least 0.9 m$^3$.

3. The bale of filter tow of claim 1, wherein said packing density is from 350 kg/m$^3$ and 800 kg/m$^3$.

4. The bale of filter tow of claim 1, wherein said bale includes a height of at least 970 mm.

5. The bale of filter tow of claim 4, wherein said height is between 970 mm and 1,200 mm.

6. The bale of filter tow of claim 1, wherein said packaging material includes a plastic film.

7. The bale of filter tow of claim 1, wherein at least 90% of the area of said upper side which is located within the inscribed rectangle is less than 25 mm from the plate.

8. The bale of filter tow of claim 1, wherein at least 90% of the area of said upper side which is located within the inscribed rectangle is less than 10 mm from the plate.

9. The bale of filter tow of claim 6, wherein said film includes polyethylene.

10. The bale of filter tow of claim 1, wherein said packaging material includes a laminated film having a layer of polyamide and a layer of polyethylene.

11. The bale of filter tow of claim 1, wherein said packaging material includes a thickness, said thickness is between 100 and 400 μm.

12. The bale of filter tow of claim 1, further including transport packaging adjacent said upper and lower sides, said transport packaging includes cardboard.

13. The bale of filter tow of claim 12, further including straps wrapped about said transport packaging and said bale.

14. A packaged, highly mechanically compressed bale of filter tow comprising:

a plurality of layers of filter tow material are layed in successive layers from a lower side to an upper side defining an upper and lower side of an upright said bale of filter tow having a packing density, wherein said bale of filter tow is in block form, and wherein said upper and lower sides are without interfering bulges;

said packing density is at least 300 kg/m$^3$ from said mechanical compression only;

an elastic packaging material fully enclosing said bale in a mechanically self-supporting manner;

said packaging material includes at least one joint which is air-tight with respect to convection;

wherein said upper and lower sides are substantially planar, such that when said lower side of said bale is placed on a horizontal surface, a flat plate can be pressed onto said upper side of said bale with a force of 100N acting in the normal direction on a center of said bale wherein a rectangle can be inscribed in a vertical projection of said bale onto the pressed-on plate, and at least 90% of the area of said upper side which is located within the inscribed rectangle is less than 40 mm from the plate;

wherein in said packaged bale a negative pressure from about 0.01 bar to about 0.4 bar relative to an outside pressure is present at least immediately after said bale has been packaged, wherein said packaging material maintains said negative pressure and equalizes pressure gradients at said upper and lower sides, and wherein said negative pressure reduces the pressure which the elastic restoring force of said filter tow material exerts on the packaging from the inside such that a stacking orientation includes a lower side of one said bale is securely stackable directly upon an upper side of another said bale; and, said stacking orientation of both said bales is the same as the orientation of said plurality of layers of filter tow material.

15. The bale of filter tow of claim 14, wherein at least 90% of the area of said upper side which is located within the inscribed rectangle is less than 25 mm from the plate.

16. The bale of filter tow of claim 14, wherein at least 90% of the area of said upper side which is located within the inscribed rectangle is less than 10 mm from the plate.

17. A packaged, highly mechanically compressed bale of filter tow in block form without interfering bulges or constrictions in the top or bottom surface of the bale comprising:

said bale has a packing density from about 300 kg/m$^3$ to about 800 kg/m$^3$;

said bale is completely wrapped in a mechanically self-supporting, elastic packaging material, wherein the material has one or more joints which are air-tight with respect to convection, wherein said bale of filter tow is in block form, and wherein said upper and lower sides are without interfering bulges;

the top and bottom surfaces of the bale are so flat that, when the unopened bale is placed on a horizontal surface, a flat plate can be pressed onto the top of the bale by a force of 100 N acting in the normal direction on the center of the bale with the result that, within the largest rectangle which can be inscribed in a vertical projection of the bale onto the pressed-on plate, at least 90% of the area of the top surface of the bale which is located within the inscribed rectangle is no more than approximately 40 mm away from the flat plate wherein said packaging material maintains said negative pressure and equalizes pressure gradients at said upper and lower sides such that a stacking orientation includes a lower side of one said bale is securely stackable directly upon an upper side of another said bale;

said stacking orientation of both said bales is the same as the orientation of said plurality of layers of filter tow material;

wherein said packaging material includes at least one or more convective joints that are air-tight connections with respect to air convection; and, wherein said packaging material is sealed by heat sealing said air-tight connective joints.

18. A packaged, highly mechanically compressed bale of filter tow comprising:

a plurality of layers of filter tow material are layed in successive layers from a lower side to an upper side defining an upper and lower side of an upright said bale of filter tow having a packing density, wherein said bale of filter tow is in block form, and wherein said upper and lower sides are without interfering bulges;

said packing density is at least 300 kg/m$^3$;

a resilient packaging material fully enclosing said bale wherein said packaging material includes at least one convective air-tight connection;

said upper side and said lower side are substantially planar wherein the planarity of said upper and lower sides is defined, such that when an unopened bale is placed on a horizontal surface, a flat plate can be pressed onto said upper side of said bale by a force of 100N acting in the normal direction on a center of said bale wherein, within the largest rectangle which can be inscribed in a vertical projection of said bale onto the pressed-on plate, at least 90% of the area of said upper side of said bale which is located within the inscribed rectangle is less than 40 mm from the plate;

said bale includes a height of at least 900 mm;

wherein the packaged said bale includes a negative pressure from about 0.15 to about 0.4 bar below ambient pressure at least after said bale has been packaged wherein said packaging material maintains said negative pressure and equalizes pressure gradients at said upper and lower sides such that a lower side of one said bale is securely stackable directly upon an upper side of another said bale;

wherein said packaging material includes at least one or more convective joints that are air-tight connections with respect to air convection; and, wherein said packaging material is sealed by heat sealing said air-tight connective joints.

19. A mechanically compressed and packaged bale of filter tow comprising:

a plurality of layers of filter tow material are layed from a lower side to an upper side in successive overlying layers in an upright orientation defining an upper side and a lower side of said bale of filter tow having a packing density, wherein each said bale of filter tow includes a cuboid shape;

said mechanical compression provides said packing density of at least 350 kg/m$^3$;

a resilient elastic packaging material fully enclosing said bale in a mechanically self-supporting manner, wherein said packaging material includes convective joints that are air-tight connections with respect to air convection;

said upper side and said lower side of each said bale are substantially planar and thereby provide a planar said lower side of at least one bale in an upright orientation for stacking directly thereupon a planar upper side of at least another bale in an upright orientation;

a working orientation of each said bale is in an upright orientation aligned with said layers of filter tow material;

said bales are maintained in said upright orientation from said laying of filter tow, to said stacking, and then to said working;

each said bale includes a height of at least 900 mm;

said packaged bale includes a negative pressure from about 0.01 bar to about 0.4 bar below ambient pressure present at least immediately after said bale has been packaged, wherein said packaging material maintains said negative pressure and equalizes pressure gradients at said upper and lower sides, and wherein said negative pressure reduces the pressure which the elastic restoring force of said filter tow material exerts on the packaging from the inside such that said lower side of said at least one bale is securely stackable directly upon said upper side of said at least another said bale; and, wherein said air-tight connections include heat sealed seams.

20. The bale of filter tow of claim 19, wherein said height is at least 970 mm.

21. The bale of filter tow of claim 19, wherein each said bale has a packing density from about 350 kg/m$^3$ to about 800 kg/m$^3$.

* * * * *